US008684684B2

(12) United States Patent
Clements et al.

(10) Patent No.: US 8,684,684 B2
(45) Date of Patent: Apr. 1, 2014

(54) TURBINE ASSEMBLY WITH END-WALL-CONTOURED AIRFOILS AND PREFERENTTIAL CLOCKING

(75) Inventors: Jeffrey Donald Clements, Mason, OH (US); Vidhu Shekhar Pandey, West Chester, OH (US); Ching-Pang Lee, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 628 days.

(21) Appl. No.: 12/872,770

(22) Filed: Aug. 31, 2010

(65) Prior Publication Data

US 2012/0051894 A1 Mar. 1, 2012

(51) Int. Cl.
*F01D 1/02* (2006.01)

(52) U.S. Cl.
USPC ..... 415/193; 415/199.4

(58) Field of Classification Search
USPC ..... 415/187, 193, 199.4, 199.5, 209.1; 416/193 A
See application file for complete search history.

(56) References Cited

U.S. PATENT DOCUMENTS

| | | | | |
|---|---|---|---|---|
| 4,585,395 | A * | 4/1986 | Nourse et al. | 416/223 A |
| 5,486,091 | A | 1/1996 | Sharma | |
| 6,283,713 | B1 * | 9/2001 | Harvey et al. | 416/193 A |
| 6,402,485 | B2 | 6/2002 | Hong et al. | |
| 6,491,493 | B1 * | 12/2002 | Watanabe et al. | 415/191 |
| 6,669,445 | B2 | 12/2003 | Staubach et al. | |
| 7,094,027 | B2 * | 8/2006 | Turner et al. | 415/194 |
| 7,134,842 | B2 | 11/2006 | Tam et al. | |
| 7,220,100 | B2 | 5/2007 | Lee et al. | |
| 7,354,243 | B2 * | 4/2008 | Harvey | 415/191 |
| 7,645,119 | B2 * | 1/2010 | Nomura et al. | 415/191 |
| 2002/0048510 | A1 * | 4/2002 | Spano et al. | 415/1 |
| 2007/0258810 | A1 | 11/2007 | Aotsuka et al. | |
| 2007/0258819 | A1 * | 11/2007 | Allen-Bradley et al. | 416/193 A |
| 2008/0267772 | A1 * | 10/2008 | Harvey et al. | 415/191 |
| 2010/0122538 | A1 * | 5/2010 | Ning et al. | 60/806 |
| 2012/0051900 | A1 * | 3/2012 | Clements et al. | 415/208.2 |

* cited by examiner

*Primary Examiner* — Edward Look
*Assistant Examiner* — Liam McDowell
(74) *Attorney, Agent, or Firm* — W. Scott Andes, Esq.; Trego, Hines & Ladenheim, PLLC

(57) ABSTRACT

A turbine apparatus includes: A first nozzle comprising an array of first vanes each including a concave pressure side, a convex suction side, and leading and trailing edges; A rotor downstream from the first nozzle comprising a plurality of blades carried by a rotatable disk; and a second nozzle disposed downstream from the rotor comprising an array of second vanes each including a concave pressure side, a convex suction side, and leading and trailing edges; wherein the first and second vanes of the first and second nozzles are circumferentially clocked relative to each other such that, in a predetermined operating condition, wakes discharged from the first vanes are aligned in a circumferential direction with the leading edges of the second vanes, wherein a stacking axis of the first vanes is nonlinear. An inner band of the first nozzle is contoured in a non-axisymmetric shape.

12 Claims, 11 Drawing Sheets

TURBINE ASSEMBLY WITH END-WALL-CONTOURED AIRFOILS AND PREFERENTTIAL CLOCKING

The U.S. Government may have certain rights in this invention pursuant to contract number W911W6-07-2-0002 awarded by the Department of the Army.

BACKGROUND OF THE INVENTION

This invention relates generally to gas turbine engines and more particularly to the configuration of turbine airfoils within such engines.

In a gas turbine engine, air is pressurized in a compressor and subsequently mixed with fuel and burned in a combustor to generate combustion gases. One or more turbines downstream of the combustor extract energy from the combustion gases to drive the compressor, as well as a fan, shaft, propeller, or other mechanical load. Each turbine comprises one or more rotors each comprising a disk carrying an array of turbine blades or buckets. A stationary nozzle comprising an array of stator vanes having radially outer and inner endwalls in the form of annular bands is disposed upstream of each rotor, and serves to optimally direct the flow of combustion gases into the rotor. Collectively each nozzle and the downstream rotor is referred to as a "stage" of the turbine.

The complex three-dimensional (3D) configuration of the vane and blade airfoils is tailored for maximizing efficiency of operation, and varies radially in span along the airfoils as well as axially along the chords of the airfoils between the leading and trailing edges. Accordingly, the velocity and pressure distributions of the combustion gases over the airfoil surfaces as well as within the corresponding flow passages also vary.

Undesirable pressure losses in the combustion gas flowpaths correspond with undesirable reduction in overall turbine efficiency. One common source of turbine pressure losses is the formation of horseshoe vortices generated as the combustion gases are split in their travel around the airfoil leading edges. A total pressure gradient is effected in the boundary layer flow at the junction of the leading edge and endwalls of the airfoil. This pressure gradient at the airfoil leading edges forms a pair of counterrotating horseshoe vortices which travel downstream on the opposite sides of each airfoil near the endwall. Migration of the horseshoe vortices generates a cross-passage vortex. The horseshoe and passage vortices create a total pressure loss and a corresponding reduction in turbine efficiency. These vortices also create turbulence and increase undesirable heating of the endwalls.

It is known to use 3D contouring of the endwalls (e.g. platform or shroud) of turbine airfoils to endwall contouring design reduces the strength of the horseshoe and passage vortices and the associated pressure losses, and thereby improve the turbine efficiency.

It is further known to orient or "clock" an upstream row of turbine vanes with a downstream row of turbine vanes in order to cause the wakes from the upstream vanes trailing edges to impinges on the downstream vane leading edges, where a set of rotating blades are positioned between the two rows of vanes. This concept attempts to have the lower momentum wakes impinging on the downstream vane leading edges to keep the wakes within the boundary layers of the vanes and thereby minimize the undesirable pressure losses.

Because the wakes are chopped by the rotating blade row before reaching the downstream nozzle vane leading edges, the position of the wakes are shifted as function of the blade rotating speed. For a constant rotating RPM, the tangential speed varies from the blade root to the tip. Therefore, the wake positions are shifted non-uniformly from the hub to the tip.

Accordingly, it is desirable to minimize vortex effects while also providing better alignment of nozzle wakes with a downstream nozzle.

BRIEF SUMMARY OF THE INVENTION

The above-mentioned need is met by the present invention, which provides a turbine assembly having nozzles and blades with 3D-countoured endwalls and preferential clocking between two rows of nozzle vanes.

According to one aspect of the invention, a turbine apparatus includes: A first nozzle comprising an array of first vanes disposed between an annular inner band and an annular outer band, each of the first vanes including a concave pressure side and a laterally opposite convex suction side extending in chord between opposite leading and trailing edges, the first vanes arranged so as to define a plurality of first flow passages therebetween bounded in part by an inner band, wherein a surface of the inner band is contoured in a non-axisymmetric shape; a rotor disposed downstream from the first nozzle and comprising a plurality of blades carried by a rotatable disk, each blade including an airfoil having a root, a tip, a concave pressure side, and a laterally opposite convex suction side, the pressure and suction sides extending in chord between opposite leading and trailing edges; and a second nozzle disposed downstream from the rotor comprising an array of second vanes disposed between an annular inner band and an annular outer band, each of the second vanes including a concave pressure side and a laterally opposite convex suction side extending in chord between opposite leading and trailing edges, the second vanes arranged so as to define a plurality of second flow passages therebetween. The first and second vanes of the first and second nozzles are circumferentially clocked relative to each other such that, in a predetermined operating condition, wakes discharged from the first vanes are aligned in a circumferential direction with the leading edges of the second vanes, wherein a stacking axis of the first vanes is nonlinear.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
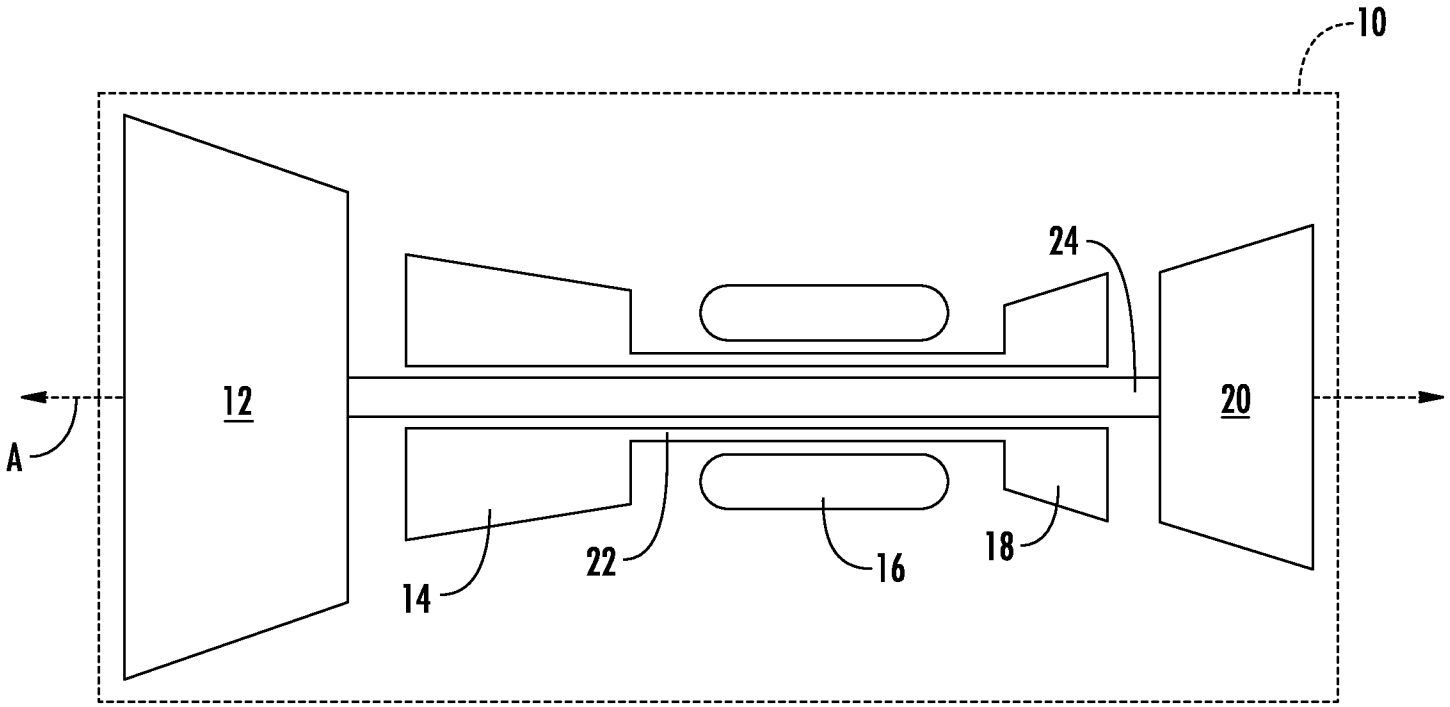
FIG. 1 is a schematic view of a gas turbine engine incorporating a turbine assembly constructed according to an aspect of the present invention.

Referring to the drawings wherein identical reference numerals denote the same elements throughout the various views, FIG. 1 depicts schematically the elements of an exemplary gas turbine engine 10 having a fan 12, a high pressure compressor 14, a combustor 16, a high pressure turbine ("HPT") 18, and a low pressure turbine 20, all arranged in a serial, axial flow relationship along a central longitudinal axis "A". Collectively the high pressure compressor 14, the combustor 16, and the high pressure turbine 18 are referred to as a "core". The high pressure compressor 14 provides compressed air that passes into the combustor 12 where fuel is introduced and burned, generating hot combustion gases. The hot combustion gases are discharged to the high pressure turbine 18 where they are expanded to extract energy therefrom. The high pressure turbine 18 drives the compressor 10 through an outer shaft 22. Pressurized air exiting from the high pressure turbine 18 is discharged to the low pressure turbine ("LPT") 20 where it is further expanded to extract energy. The low pressure turbine 20 drives the fan 12 through an inner shaft 24. The fan 12 generates a flow of pressurized air, a portion of which supercharges the inlet of the high pressure compressor 14, and the majority of which bypasses the "core" to provide the majority of the thrust developed by the engine 10.

While the illustrated engine 10 is a high-bypass turbofan engine, the principles described herein are equally applicable to turboprop, turbojet, and turboshaft engines, as well as turbine engines used for other vehicles or in stationary applications. Furthermore, while a LPT is used as an example, it will be understood that the principles of the present invention may be applied to any turbine having inner and outer shrouds or platforms, including without limitation HPT and intermediate-pressure turbines ("IPT"). Furthermore, the principles described herein are also applicable to turbines using working fluids other than air, such as steam turbines.

Figure 2:
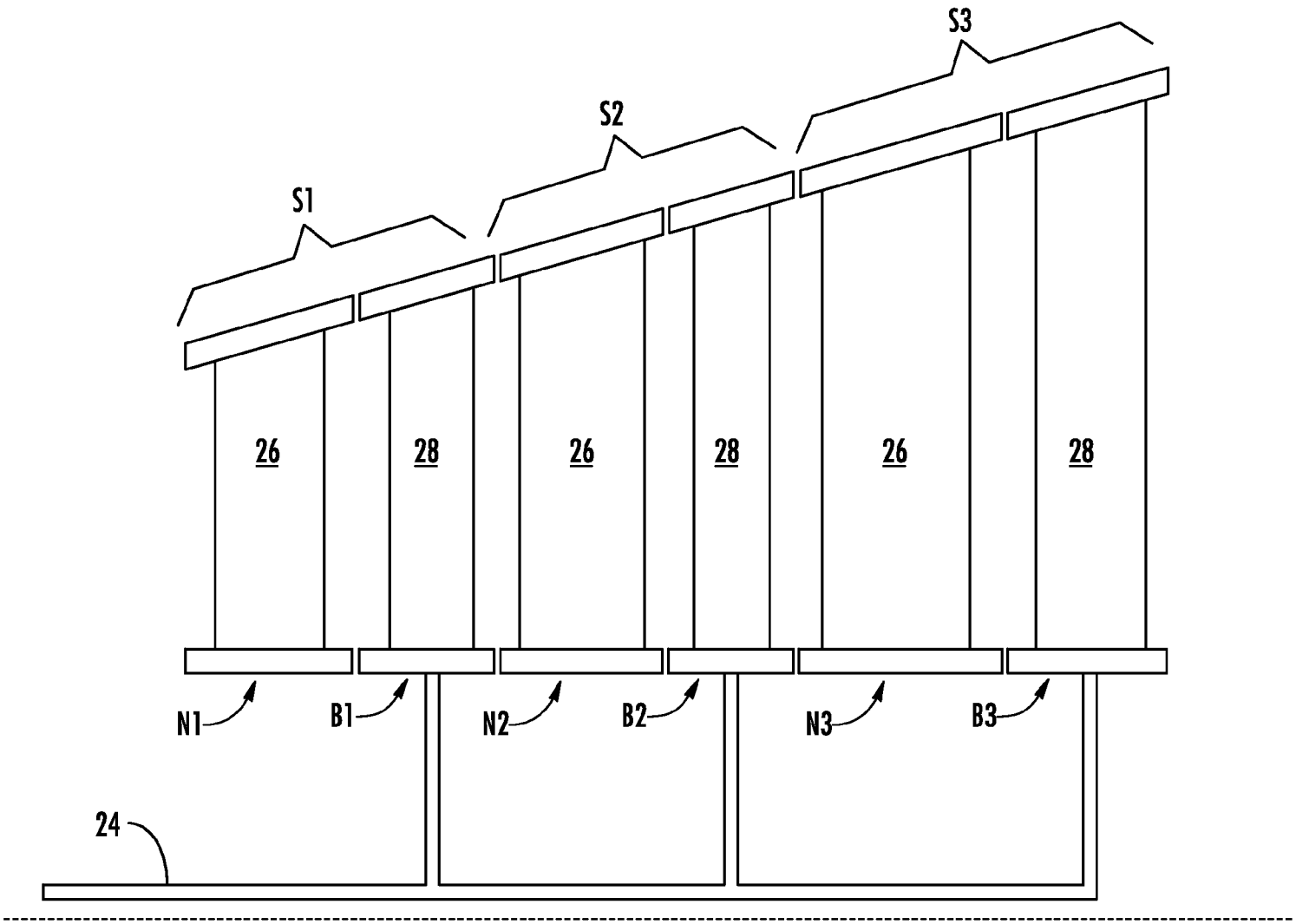
FIG. 2 is a schematic diagram of a low-pressure turbine of the engine shown FIG. 1.

Referring to FIG. 2, the LPT 20 includes first, second, and third stages S1, S2, and S3, respectively. Each stage includes a nozzle 26 comprising an annular array of stationary turbine vanes and a downstream rotor comprising a rotating disk carrying an annular array of turbine blades 28. The rotors are all co-rotating and coupled to inner shaft 24. For reference purposes the nozzles (or vane rows) of the first, second, and third stages S1, S2, and S3 are denoted N1, N2, and N3, while the respective rotors (or blade rows) are denoted B1, B2, and B3.

Figure 3:
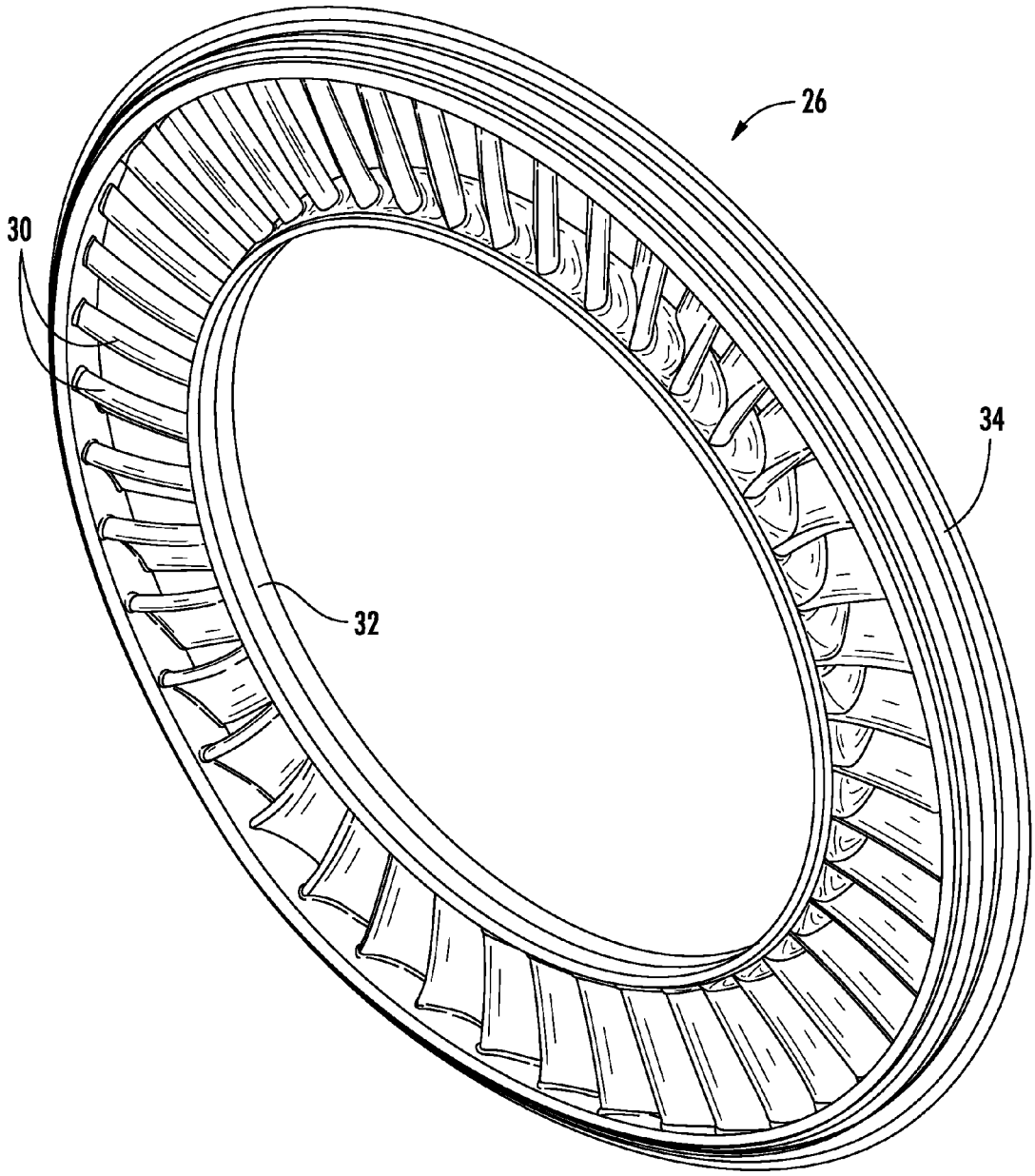
FIG. 3 is a perspective view of a turbine nozzle of the engine shown in FIG. 1.
Figure 4:
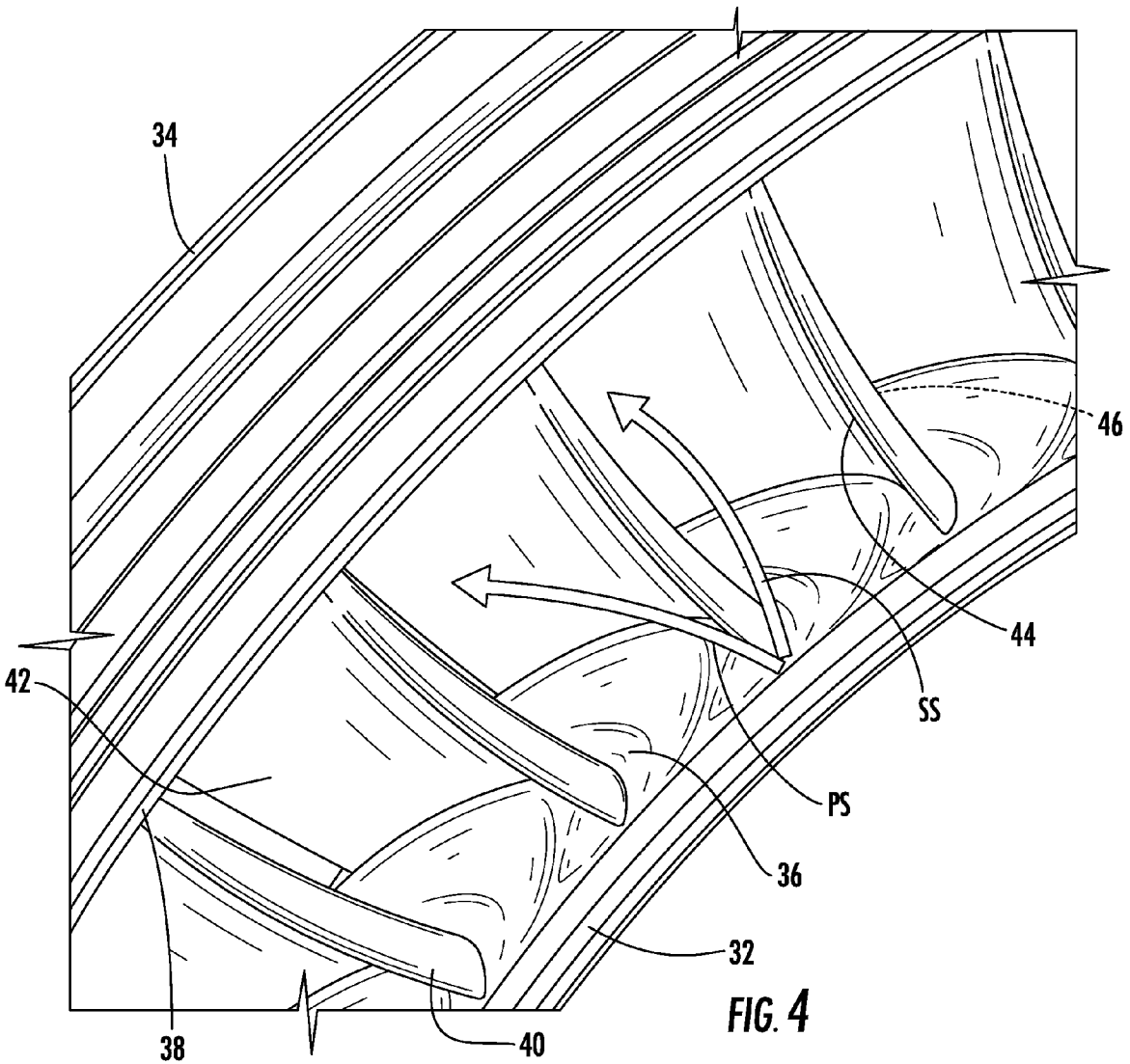
FIG. 4 is an enlarged view of a portion of the turbine nozzle shown in FIG. 3.

FIGS. 3 and 4 illustrate one of the turbine nozzles 26, which is generally representative of the overall design of the nozzles N1, N2, N3 of all three stages S1, S2, S3. The nozzle 26 may be of unitary or built-up construction and includes a plurality of turbine vanes 30 disposed between an annular inner band 32 and an annular outer band 34. Each vane 30 is an airfoil including a root 36, a tip 38, a leading edge 40, trailing edge 42, and a concave pressure side 44 opposed to a convex suction side 46. The innerand outer bands 32 and 34 define the inner and outer radial boundaries, respectively, of the gas flow through the turbine nozzle 26. The inner band 32 has a "hot side" 48 facing the hot gas flowpath and a "cold side" facing away from the hot gas flowpath, and includes conventional mounting structure. Similarly, the outer band 34 has a cold side and a hot side and includes conventional mounting structure.

In operation, the gas pressure gradient at the airfoil leading edges causes the formation of a pair of counterrotating horseshoe vortices which travel downstream on the opposite sides of each airfoil near the inner band 32. FIG. 4 illustrates schematically the direction of travel of these vortices, where the pressure side and suction side vortices are labeled PS and SS, respectively.

In this particular example, for the second-stage nozzle N2, The hot side 48 of the inner band 32, specifically the portion of the inner band between each vane 30, is preferentially contoured in elevation relative to a conventional axisymmetric or circular circumferential profile in order to reduce the adverse effects of the vortices generated as the combustion gases split around the leading edges 40 of the vanes 30 as they flow downstream over the inner band 32 during operation. The inner band contour is contoured in radial elevation from a wide peak 50 adjacent the pressure side 44 of each vane 28 to a depressed narrow trough 52. This contouring is referred to generally as "3D-contouring".

Figure 5:
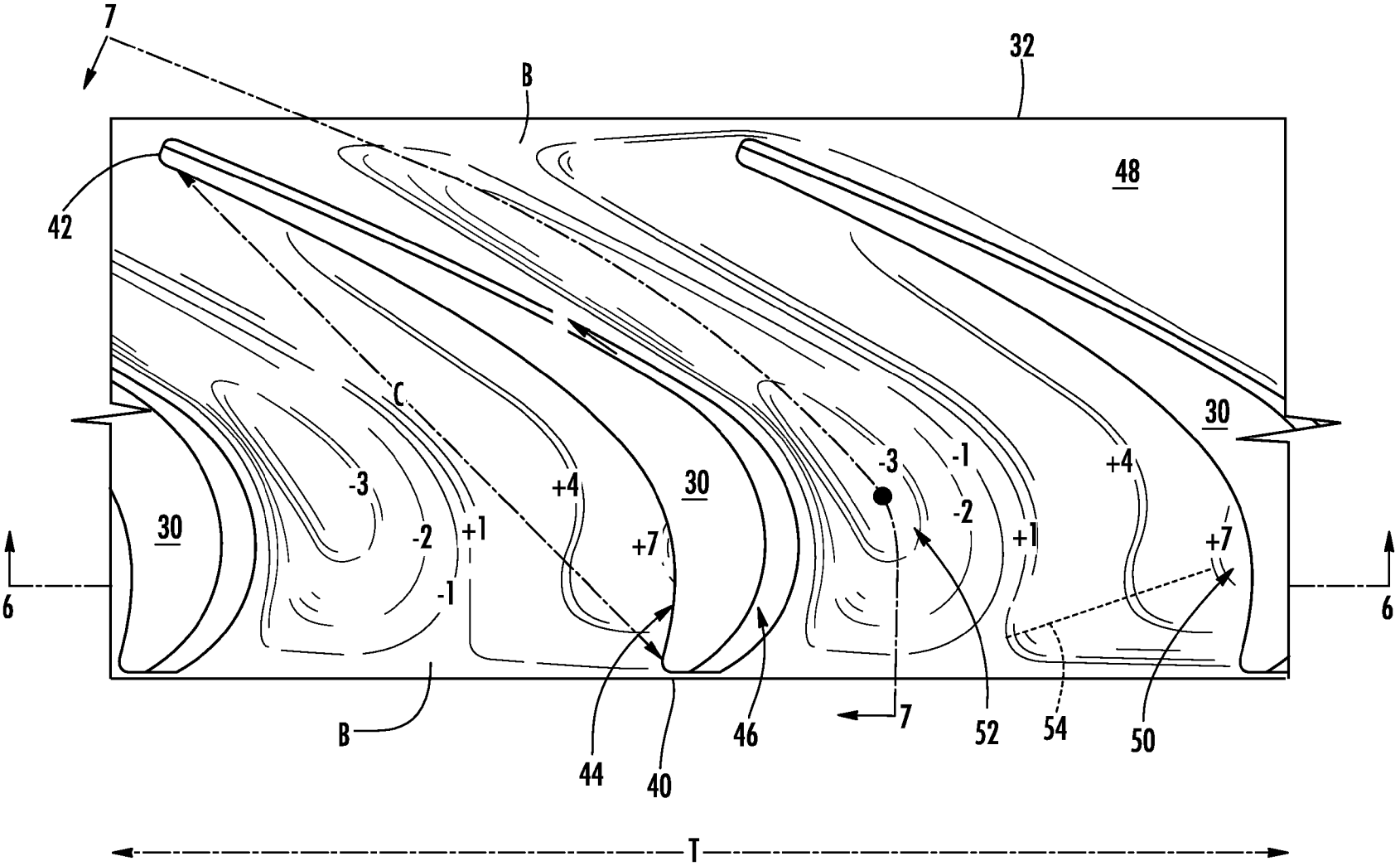
FIG. 5 is a cross-sectional view of a portion of the turbine nozzle shown in FIG. 3.

The 3D-contouring is explained with reference to FIGS. 5-7. A typical prior art inner band generally has a surface profile which is convexly-curved in a shape similar to the top surface of an airfoil when viewed in longitudinal cross-section (see FIG. 6). This profile is a symmetrical surface of revolution about the longitudinal axis A of the engine 10. This profile is considered a baseline reference, and in each of FIGS. 5-7, a baseline prior art surface profile is illustrated with a dashed line denoted "B"and the 3D-contoured surface profile is shown with a solid line. Points having the same height or radial dimension are interconnected by contour lines in the figures. As seen in FIG. 5, each of the vanes 30 has a chord length "C" measured from its leading edge 40 to its trailing edge 42, and a direction parallel to this dimension denotes a "chordwise" direction. A direction parallel to the forward or aft edges of the inner band 32 is referred to as a tangential direction as illustrated by the arrow marked "T" in FIG. 5. As used herein, it will be understood that the terms "positive elevation", "peak"and similar terms refer to surface characteristics located radially outboard or having a greater radius measured from the longitudinal axis A than the local baseline B, and the terms "trough", "negative elevation", and similar terms refer to surface characteristics located radially inboard or having a smaller radius measured from the longitudinal axis A than the local baseline B.

Figure 7:
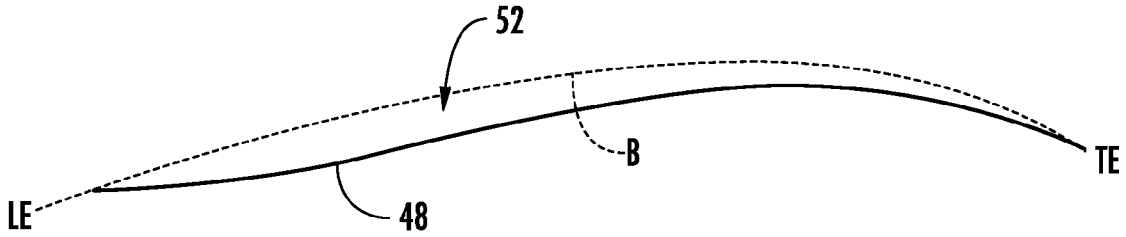
FIG. 7 is a view taken along lines 7-7 of FIG. 5.

As best seen in FIGS. 5 and 7, the trough 52 is present in the hot side 48 of the inner band 32 between each pair of vanes 30, extending generally from the leading edge 40 to the trailing edge 42. The deepest portion of the trough 52 runs along a line substantially parallel to the suction side 46 of the adjacent vane 30, coincident with the line 7-7 marked in FIG. 5. In the particular example illustrated, the deepest portion of the trough 52 is lower than the baseline profile B by approximately 30% to 40% of the total difference in radial height between the lowest and highest locations of the hot side 48, or about three to four units, where the total height difference is about 10 units. In the tangential direction, measuring from the suction side 46 of a first vane 30, the line representing the deepest portion of the trough 52 is positioned about 10% to about 30%, preferably about 20%, of the distance to the pressure side 44 of the adjacent vane 30. In the chordwise direction, the deepest portion of the trough 52 occurs at approximately the location of the maximum section thickness of the vane 30 (commonly referred to as a "high-C" location).

Figure 6:
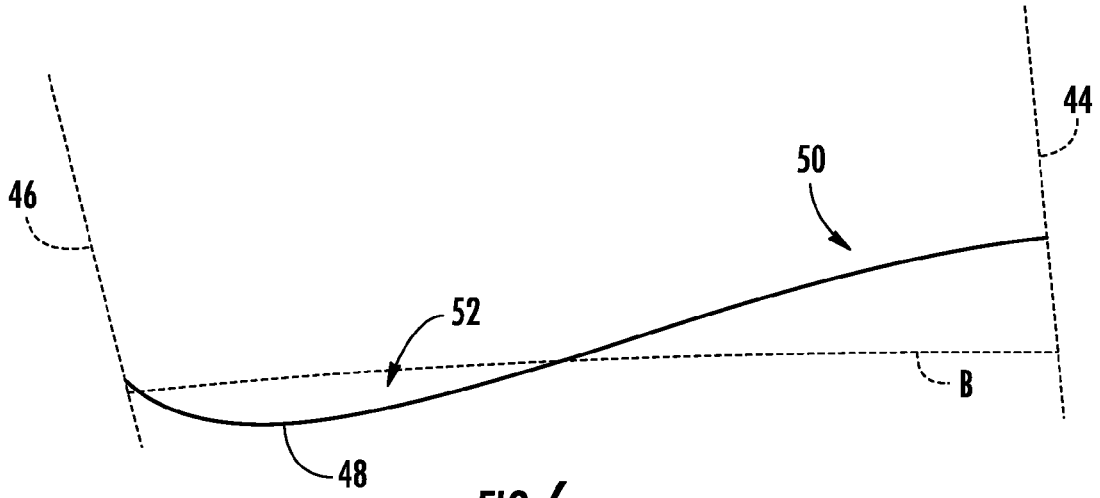
FIG. 6 is a view taken along lines 6-6 of FIG. 5.

As best seen in FIGS. 5 and 6, the peak 50 runs along a line substantially parallel to the pressure side 44 of the adjacent vane 30. A ridge 54 extends from the highest portion of the peak 50 and extends in a generally tangential direction away from the pressure side 44 of the adjacent vane 30. The radial height of the peak 50 slopes away from this ridge 54 towards both the leading edge 40 and the trailing edge 42. The peak 50 increases in elevation behind the leading edge 40 from the baseline elevation B to the maximum elevation greater with a large gradient over the first third of the chord length from the leading edge 40, whereas the peak 50 increases in elevation from the trailing edge 42 over the same magnitude over the remaining two-thirds of the chord length from the trailing edge 42 at a substantially shallower gradient or slope.

In the particular example illustrated, the highest portion of the peak 50 is higher than the baseline profile B by approximately 60% to 70% of the total difference in radial height between the lowest and highest locations of the hot side 48, or about six to seven units, where the total height difference is about 10 units. In the chordwise direction, the highest portion of the peak 50 is located between the mid-chord position and the leading edge 40 of the adjacent vane 30.

Preferably, there is no significant ridge, fillet, or other similar structure present on the hot side 48 of the inner band 32 aft of the trailing edge 42 of the vanes 30. In other words, there should be a sharply defined intersection present between the trailing edge 42 of the vanes 30 at their roots 36 and the inner band 32. For mechanical strength, it may be necessary to include some type of fillet at this location. For aerodynamic purposes any fillet present should be minimized Whereas the peak 50 is locally isolated near its maximum height, the trough 52 has a generally uniform and shallow depth over substantially its entire longitudinal or axial length. Collectively, the elevated peak 50 and depressed trough 52 provide an aerodynamically smooth chute or curved flute that follows the arcuate contour of the flowpath between the concave pressure side 44 of one vane 30 and the convex suction side 36 of the adjacent vane 30 to smoothly channel the combustion gases therethrough. In particular the peak 50 and trough 52 cooperating together conform with the incidence angle of the combustion gases for smoothly banking or turning the combustion gases for reducing the adverse effect of the horseshoe and passage vortices.

Figure 8:
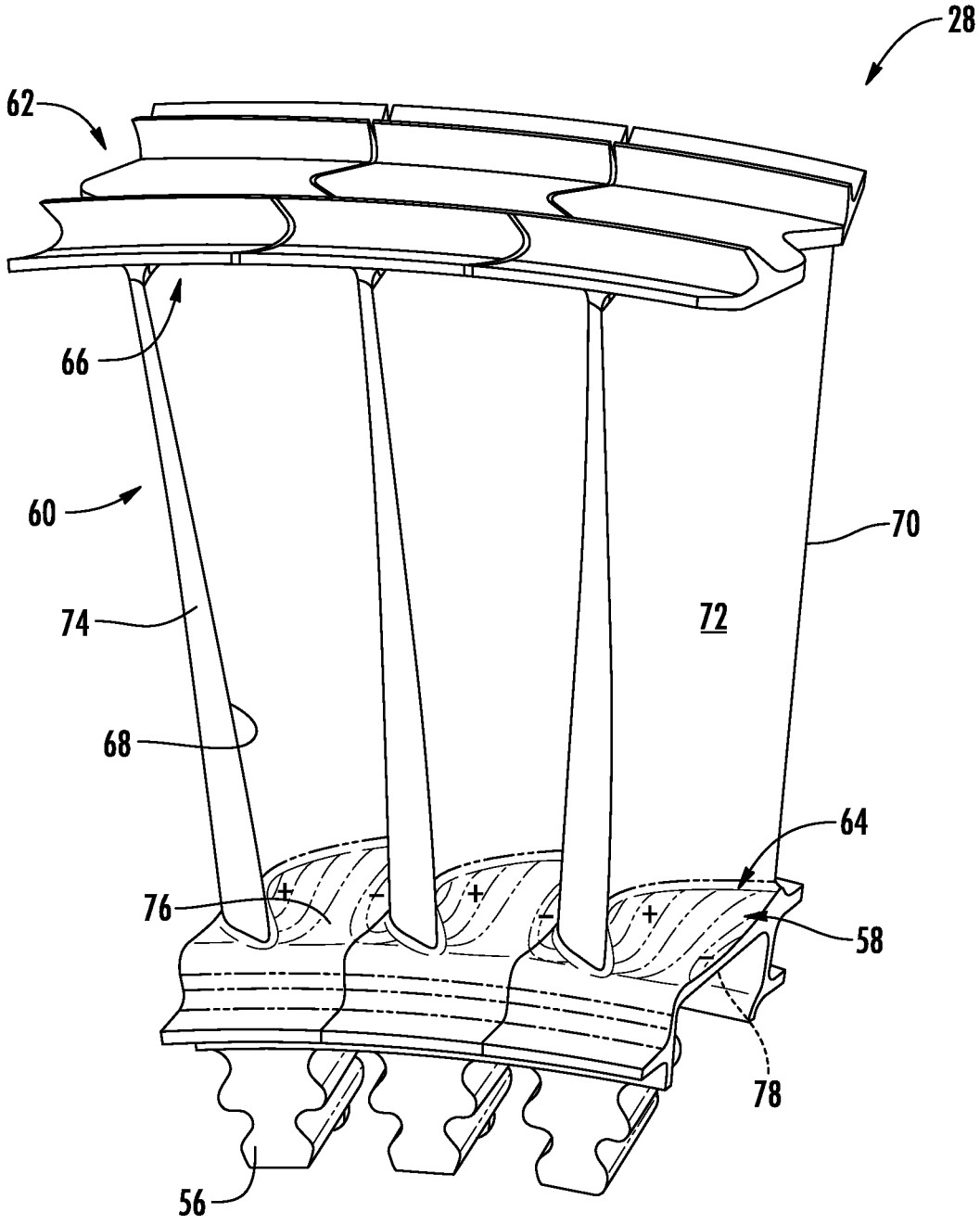
FIG. 8 is a perspective view of several turbine blades of the turbine assembly shown in FIG. 1.

FIG. 8 illustrates the construction of the turbine blades 28 (a group of three identical blades 28 are shown as they would be assembled in operation). They are generally representative of the overall design of the blades of rows B1, B2, B3 of all three stages S1, S2, S3. The blade 28 is a unitary component including a dovetail 56, an inner platform 58, an airfoil 60, and an outer platform 62. The airfoil 60 includes a root 64, a tip 66, a leading edge 68, trailing edge 70, and a concave pressure side 72 opposed to a convex suction side 74. The inner and outer platforms 58 and 62 define the inner and outer radial boundaries, respectively, of the gas flow past the airfoil 60. The inner platform 58 has a "hot side" 76 facing the hot gas flowpath and a "cold side" 78 facing away from the hot gas flowpath.

Figure 9:
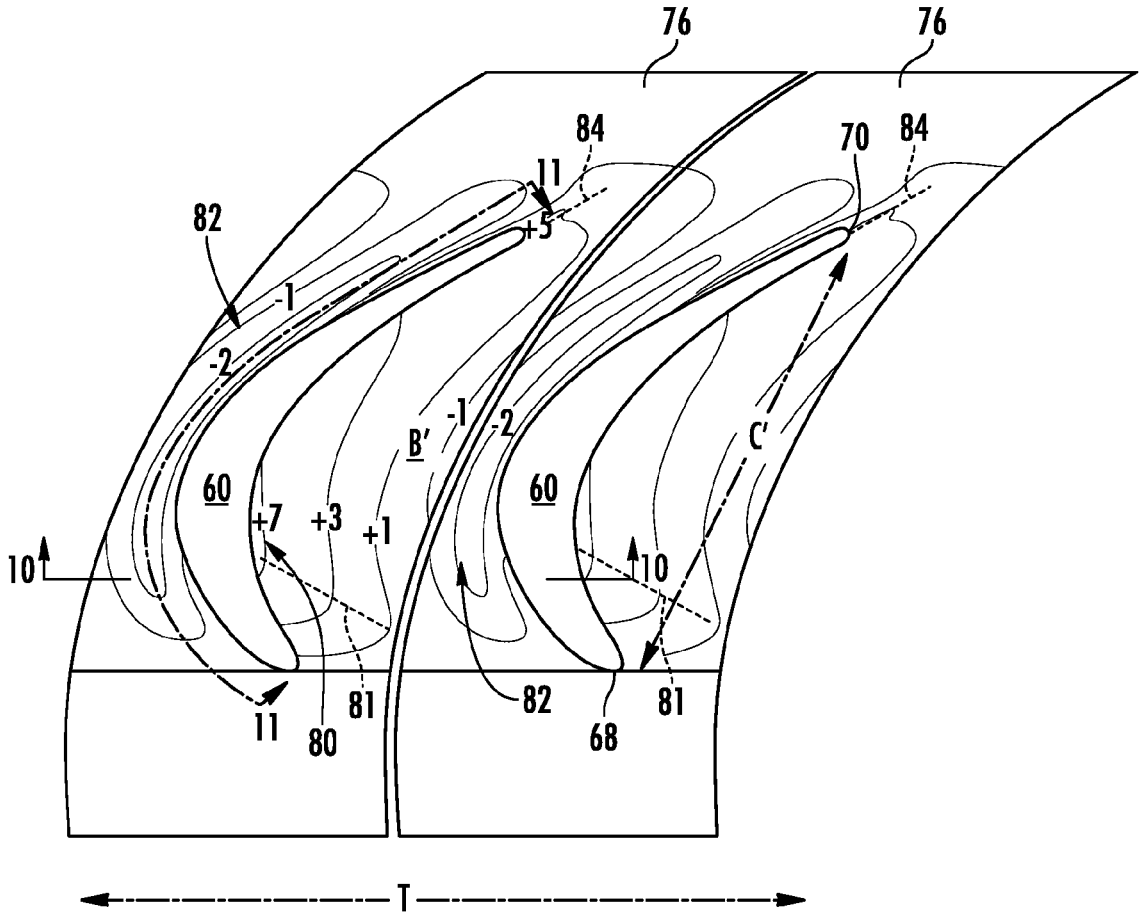
FIG. 9 is a cross-sectional view of a portion of the turbine blade shown in FIG. 8.
Figure 10:
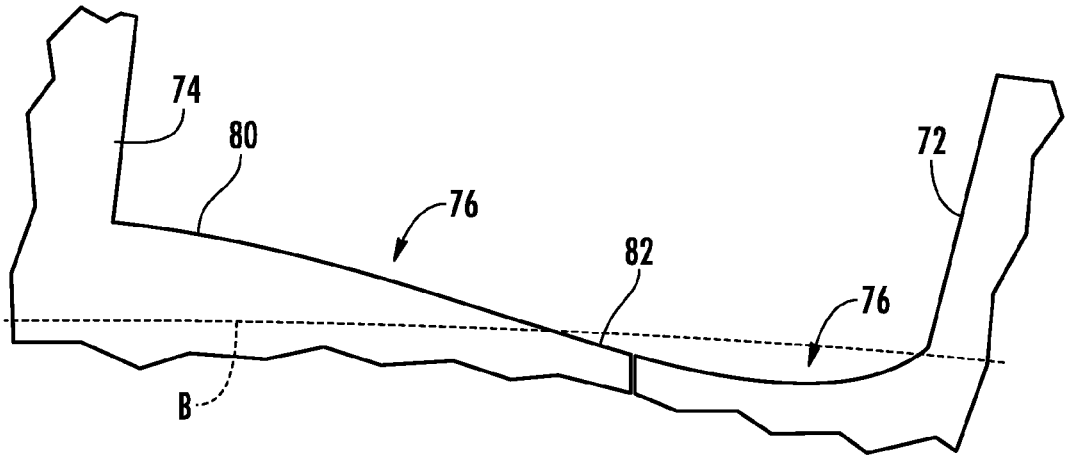
FIG. 10 is a view taken along lines 10-10 of FIG. 9.
Figure 11:
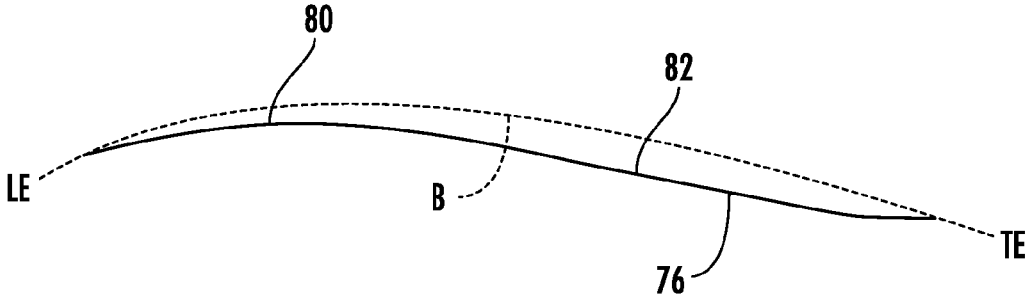
FIG. 11 is a view taken along lines 11-11 of FIG. 9.

In operation, the turbine blades 28 are subject to the same flow conditions tending to cause the generation of horseshoe and passage vortices in the vanes 30. Accordingly, as shown in FIGS. 9-11, for the blades 28 of the second blade row B2, the hot side 76 of the inner platform 58 is preferentially 3D-contoured in elevation, in much the same way as the turbine nozzle 26. In particular the inner platform contour is non-axisymmetric, with a wide peak 80 adjacent the pressure side 72 of each blade 28 transitioning to a depressed narrow trough 82. It will be understood that the complete shape defining the aerodynamic "endwall" of the passage between two adjacent airfoils 60 of the assembled rotor is defined cooperatively by portions of the side-by-side inner platforms 58 of the blades 28.

A baseline reference is denoted "B". The 3D-contoured surface profile is shown with an solid line. Points having the same height or radial dimension are interconnected by contour lines in the figures. Each of the airfoils 60 has a chord length "C"' measured from its leading edge 68 to its trailing edge 70. A tangential direction is illustrated by the arrow marked "T".

The trough 82 is present in the hot side 76 of the inner platform 58 between each pair of airfoils 60, extending generally from the leading edge 68 to the trailing edge 70. The deepest portion of the trough 82 runs along a line substantially parallel to the suction side 74 of the airfoil 60, coincident with the line 11-11 marked in FIG. 9. In the particular example illustrated, the deepest portion of the trough 82 is lower than the baseline profile B' by approximately 20% of the total difference in radial height between the lowest and highest locations of the hot side 76, or about 2 units, where the total height difference is about 8.5 units. In the tangential direction, measuring from the suction side 74 of an airfoil 60, the line representing the deepest portion of the trough 82 is positioned about 10% of the distance to the pressure side 72 of the adjacent airfoil 60. In the chordwise direction, the deepest portion of the trough 82 occurs at approximately the location of the maximum section thickness of the airfoil 60.

The peak 80 runs along a line substantially parallel to the pressure side 72 of the adjacent airfoil 60. A ridge 81 extends from the highest portion of the peak 80 and extends in a generally tangential direction away from the pressure side 72 of the adjacent airfoil 60. The radial height of the peak 80 slopes away from this ridge 81 towards both the leading edge 68 and the trailing edge 70. The peak 80 increases in elevation behind the leading edge 68 from the baseline elevation B' to the maximum elevation with a large gradient over the first third of the chord length from the leading edge 68, whereas the peak 80 increases in elevation from the trailing edge 70 over the same magnitude over the remaining two-thirds of the chord length from the trailing edge 70 at a substantially shallower gradient or slope.

In the particular example illustrated, the highest portion of the peak 80 is higher than the baseline profile B' by approximately 80% of the total difference in radial height between the lowest and highest locations of the hot side 76, or about 7 units, where the total height difference is about 8.5 units. In the chordwise direction, the highest portion of the peak 80 is located between the mid-chord position and the leading edge 68 of the adjacent airfoil 60.

A trailing edge ridge 84 is present in the hot side 76 of the inner platform 58 aft of the airfoil 60 It runs aft from the trailing edge 70 of the airfoil 60, along a line which is substantially an extension of the chord line of the airfoil 60. The radial height of the trailing edge ridge 84 slopes away from this line towards both the leading edge 68 and the trailing edge 70. In the particular example illustrated, the highest portion of the trailing edge ridge 84 is higher than the baseline profile B' by approximately 60% of the total difference in radial height between the lowest and highest locations of the hot side 76, or about 5 units, where the total height difference is about 8.5 units. The highest portion of the trailing edge ridge 84 is located immediately adjacent the trailing edge 70 of the airfoil 60 at its root 64.

It is noted that the specific numerical values described above are merely examples and that they may be varied to provide optimum performance for a specific application. For example, the radial heights noted above could easily be varied by plus or minus 20%, and the tangential locations could be varied by plus or minus 15%.

Computer analysis of the 3D-contoured configuration described above predicts significant reduction in aerodynamic pressure losses near the inner band of the second stage nozzle N2 and the inner platform of the second stage blades B2 during engine operation. The improved pressure distribution extends from the inner end wall structures over a substantial portion of the lower span of the vanes 30 and airfoils 60 to significantly reduce vortex strength and cross-passage pressure gradients that drive the horseshoe vortices toward the airfoil suction sides 46 and 74. The 3D contoured hot sides 48 and 76 also decreases vortex migration toward the mid-span of the vanes 30 and airfoils 60, respectively, while reducing total pressure loss. These benefits increase performance and efficiency of the LPT 20 and engine 10.

Figure 12:
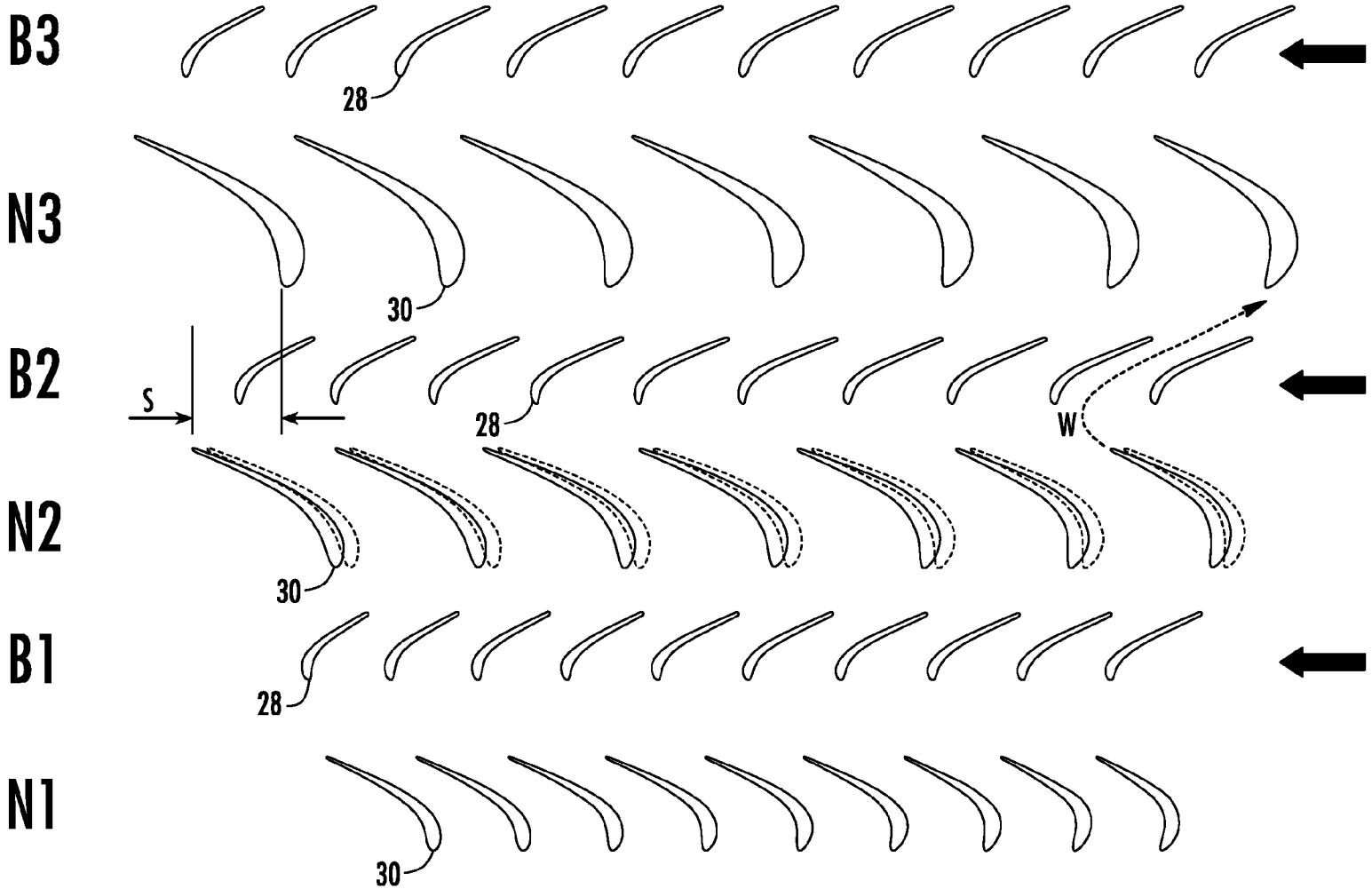
FIG. 12 is a schematic view of the rows of turbine vanes and blades of a low-pressure turbine of the engine of FIG. 1.

The LPT 20 additionally benefits from preferential clocking of its airfoils. The term "clocking" as used in the gas turbine field refers generally to the angular orientation of an annular array of turbine airfoils, or more specifically to the relative angular orientation of two or more rows of airfoils. FIG. 12 illustrates schematically the nozzle rows N1, N2, and N3, and the blade rows B1, B2, and B3. The arrow marked "W" depicts the trailing edge wake from a vane 30 of the nozzle row N2 which is turned by the blade row B2 as it travels downstream before impinging on the nozzle row N3. The wake W represents the flow disturbance caused by the presence of the nozzle N2. The principles of the present invention will be explained using nozzle rows N2 and N3 as examples, with the understanding that they are applicable to any pair of turbine nozzles arranged in an upstream/downstream relationship with a rotating blade row between them.

The individual rows of airfoils (vanes 30 or blades 28) are circumferentially spaced apart from each other in each row with an equal spacing represented by the pitch from airfoil-to-airfoil in each row. The circumferential pitch is the same from the leading to trailing edges of the airfoils. The circumferential clocking between nozzle row N2 and the downstream nozzle row N3 is represented by the circumferential distance "S" from the trailing edge of the vanes 30 in row N2 relative to the leading edge of the downstream vanes in row N3. This clocking or spacing S may be represented by the percentage of the downstream airfoil pitch. Using this nomenclature, zero percent and 100% would represent no circumferential spacing between the corresponding trailing and leading edges, and a 50% spacing would represent the trailing edge of the vanes 30 in row N2 being aligned circumferentially midway between the leading edges of the vanes 16 in row N3.

In operation, the wakes W are chopped by the rotating blade row B2 before reaching the leading edges of the vanes 30 in the downstream nozzle N3, therefore shifting the circumferential position of the wakes W as function of the blade rotating speed, with higher speeds resulting a greater degree of shifting.

It is preferable to have the wake W impinge directly on the leading edge 40 of the downstream vane 30, or in other words to have the middle of the lateral extent of the wake W aligned with the leading edge 40. In the present example, the second stage nozzle N2 is preferentially oriented or "clocked" relative to the third stage nozzle N3 so as to channel trailing edge wakes W emanating from the vanes 30 of the second stage nozzle N2 to impinge on the leading edges 40 of the vanes 30 of the third stage nozzle N3, taking into account the action of the second stage blade row B2 on the wake W. It should be noted that the absolute angular orientation of each nozzle N2 or N3 to a fixed reference is not important, that is, either nozzle could be "clocked" relative to a baseline orientation in order to achieve the effect described herein.

In this specific example, best alignment of the wakes W and best aerodynamic efficiency, have been found when the angular position of the nozzle N2 is shifted somewhat clockwise, viewed aft looking forward, relative to the nozzle N3. In FIG. 12, the dashed lines indicate a baseline position of the vanes 30 in the nozzle N2, while the solid lines indicate their "clocked" position.

Figures 13A, 13B, 13C:
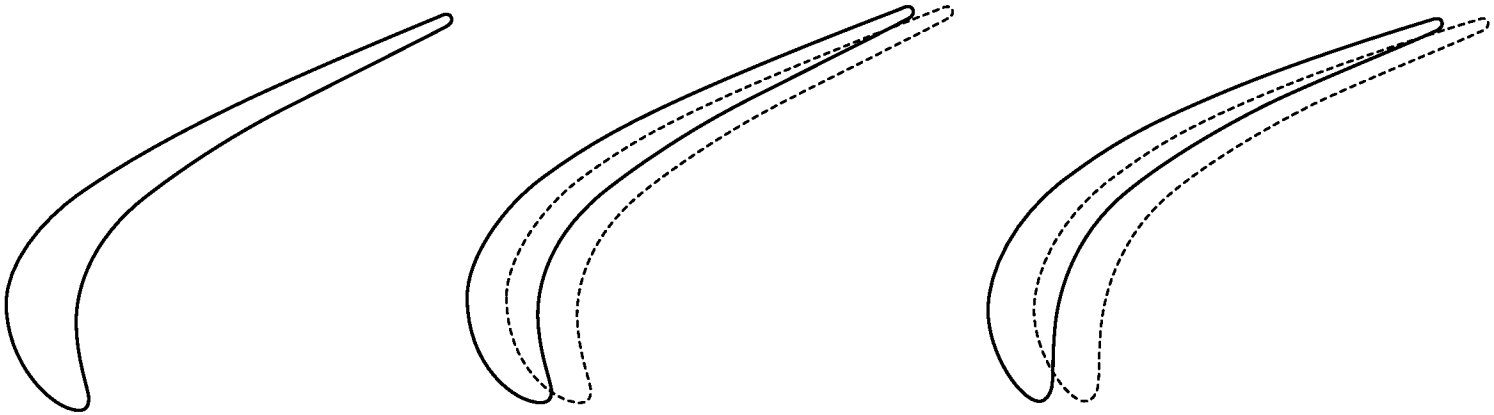
FIG. 13A is a schematic cross-sectional view of a turbine vane at a root.
FIG. 13B is a schematic view of a turbine vane at a mid-span location.
FIG. 13C is a schematic view of a turbine vane at the tip.

In conventional practice, a line passing through the centroid of successive cross-sectional slices or "stations" of the vanes 30, referred to as a "stacking axis", would be a straight line, extending radially outward from the engine's longitudinal axis A. For a constant rotating RPM (angular velocity) of the blades 28, the rotating speed (tangential velocity) varies from a minimum at the blade root 64 to a maximum at the tip 66. Therefore, the wake positions are shifted by the blades 28 non-uniformly from the root to the tip. To compensate for this varying effect, the "stacking axis" of the vanes 30 of the nozzle N2 are curved rather than linear. Specifically, the airfoil cross-section is progressively shifted or clocked to a greater degree from the root 36 to the tip 38. FIGS. 13A, 13B, and 13C show the positions of the clocked airfoil cross-sections in dashed lines, at the root 36, mid-span, and tip 38, respectively. The exact position of each airfoil cross-section can be determined by analytical methods or by empirical methods (such as rig testing). For example, the position of the wakes W would be determined by flow visualization (experimental or virtual), then the circumferential position of each airfoil cross-section of the nozzle N2 would be manipulated until the center of the wakes W impinge directly on the leading edges 40 of the vanes 30 of the downstream nozzle N3.

As noted above, the 3D endwall contouring reduces the strength of the passage vortices in the second stage nozzle N2 and the second stage blades B3. Additionally, the 3D endwall contouring reduces the "smearing" effect that would otherwise be present because of the horseshoe and passage vortices, resulting in a clearly defined wake W especially near the roots 36 and 64 of the vanes 30 and airfoils 60. This synergistically improves the effect of the preferential radial stacking described above, with the result of a better alignment of the upstream wakes W with the downstream leading edges from the root to the tip, to keep the lower momentum fluids within the boundary layers for a better aerodynamic efficiency.

Turbine rig test data and computation fluid dynamics ("CFD") analysis of this configuration indicate this combination of end-wall contouring, non-linear nozzle radial stacking and a proper clocking can achieve a significant improvement in the turbine efficiency.

The foregoing has described a turbine assembly with airfoil end-wall contouring, non-linear nozzle radial stacking and preferential clocking While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation, the invention being defined by the claims.

What is claimed is:

1. A turbine apparatus, comprising:

a first nozzle comprising an array of first vanes disposed between an annular inner band and an annular outer band, each of the first vanes including: a root, a tip, a concave pressure side and a laterally opposite convex suction side extending in chord between opposite leading and trailing edges, the first vanes arranged so as to define a plurality of first flow passages therebetween bounded in part by the inner band, wherein a surface of the inner band is contoured in a non-axisymmetric shape;

a rotor disposed downstream from the first nozzle and comprising a plurality of blades carried by a rotatable disk, each blade including an airfoil having a root, a tip, a concave pressure side, and a laterally opposite convex suction side, the pressure side and the suction side extending in chord between opposite leading and trailing edges; and a second nozzle disposed downstream from the rotor comprising an array of second vanes disposed between an annular inner band and an annular outer band, each of the second vanes including a concave pressure side and a laterally opposite convex suction side extending in chord between opposite leading and trailing edges, the second vanes arranged so as to define a plurality of second flow passages therebetween;

wherein the first vanes of the first nozzle and the second vanes of the second nozzle are circumferentially clocked relative to each other such that, in a predetermined operating condition, wakes discharged from the first vanes are aligned in a circumferential direction with the leading edges of the second vanes, wherein a stacking axis of the first vanes is nonlinear such that a plurality of cross-sectional stations spaced-apart along the stacking axis are progressively shifted in a tangential direction to a greater degree from the root of the first vanes to the tip of the first vanes.

2. The turbine apparatus of claim 1 wherein the first nozzle and the second nozzle include an equal number of vanes.

3. The turbine apparatus of claim 1 wherein the plurality of cross-sectional stations spaced-apart along the stacking axis of the first vanes are each positioned such that, in a predetermined operating condition, wakes discharged therefrom are circumferentially aligned with the leading edges of corresponding cross-sectional stations spaced-apart along the second vanes.

4. The turbine assembly of claim 1 wherein each of the turbine blades comprises:

an outer platform disposed at the tip of the airfoil, and an inner platform disposed at the root of the airfoil, the inner platform having a hot side facing the airfoil which is contoured in a non-axisymmetric shape.

5. The turbine assembly of claim 4 wherein the hot side sides of each of the inner platforms is contoured in a non-axisymmetric shape including a peak of relatively higher radial height adjoining the pressure side of one of the airfoils adjacent its leading edge, and a trough of relatively lower radial height is disposed parallel to and spaced-away from the suction side of an adjacent airfoil aft of the leading edge of one of the airfoils; and wherein the peak and the trough define cooperatively define an arcuate channel extending axially along the inner platform.

6. The turbine assembly of claim 5 wherein the peak decreases in height around the leading edge of the one of the airfoils to join the trough along the suction side of the adjacent airfoil; and the trough extends along the suction side of the adjacent airfoil to the trailing edge of the adjacent airfoil.

7. The turbine assembly of claim 5 wherein the hot side of each inner platform includes a trailing edge ridge of relatively higher radial height extending aft of the trailing edge of the airfoil.

8. The turbine blade assembly of claim 5 wherein the peak is centered at the pressure side of each airfoil between the leading edge and a mid-chord position, and decreases in height forward, aft, and laterally therefrom; and the trough is centered at the suction side near the maximum thickness of the airfoil, and decreases in depth forward, aft, and laterally therefrom.

9. The turbine blade assembly of claim 1 wherein a surface of the inner band in each of the first passages is contoured in a non-axisymmetric shape including a peak of relatively higher radial height adjoining the pressure side of one of the first vanes adjacent its leading edge, and a trough of relatively lower radial height disposed parallel to and spaced-away from the suction side of an adjacent first vane aft of its leading edge; and wherein the peak and trough define cooperatively define an arcuate channel extending axially along the inner band between the adjacent first vanes.

10. The turbine blade assembly of claim 9 wherein the peak disposed in each first passage decreases in height around each the leading edge of one of the first vanes to join the trough along the suction side of the adjacent first vane; and the trough extends along the suction sides of the adjacent first vane to its trailing edge.

11. The turbine assembly of claim 1 wherein the peak is centered at the pressure side of each first vane between the leading edge and a mid-chord position, and decreases in height forward, aft, and laterally therefrom; and the trough is centered at the suction side near the maximum thickness of the airfoils, and decreases in depth forward, aft, and laterally therefrom.

12. The turbine apparatus of claim 1 further including at least one additional stage positioned upstream or downstream therefrom, the additional stage including:

an additional nozzle comprising an array of vanes disposed between an annular inner band and an annular outer band, each of the vanes including a concave pressure side and a laterally opposite convex suction side extending in chord between opposite leading and trailing edges, the vanes arranged so as to define a plurality of flow passages therebetween; and an additional rotor disposed downstream from the additional nozzle and comprising a plurality of blades carried by a rotatable disk, each blade including an airfoil having a root, a tip, a concave pressure side, and a laterally opposite convex suction side, the pressure and suction sides extending in chord between opposite leading and trailing edges.

* * * * *